US010175008B2

(12) United States Patent
Fujisawa et al.

(10) Patent No.: US 10,175,008 B2
(45) Date of Patent: Jan. 8, 2019

(54) HEAT EXCHANGER

(71) Applicant: NORITZ CORPORATION, Hyogo (JP)

(72) Inventors: Hideyuki Fujisawa, Hyogo (JP); Kazuyuki Goto, Hyogo (JP); Joji Endo, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 209 days.

(21) Appl. No.: 15/155,441

(22) Filed: May 16, 2016

(65) Prior Publication Data

US 2016/0377348 A1 Dec. 29, 2016

(30) Foreign Application Priority Data

Jun. 25, 2015 (JP) ..... 2015-127313

(51) Int. Cl.

| | |
|---|---|
| ***F28F 9/00*** | (2006.01) |
| ***F28F 9/02*** | (2006.01) |
| ***F28D 7/02*** | (2006.01) |
| ***F28D 7/08*** | (2006.01) |
| *F28D 21/00* | (2006.01) |

(52) U.S. Cl.

CPC ..... *F28F 9/001* (2013.01); *F28D 7/024* (2013.01); *F28D 7/082* (2013.01); *F28F 9/0202* (2013.01); *F28F 9/0219* (2013.01); *F28F 9/0224* (2013.01); *F28D 2021/0024* (2013.01); *F28F 2250/06* (2013.01)

(58) Field of Classification Search

CPC ..... F24H 1/165; F28F 9/0224; F28F 9/0219; F28F 9/0229; F28F 9/0221; F28F 9/0202

USPC ..... 165/158, 173

See application file for complete search history.

(56) References Cited

U.S. PATENT DOCUMENTS 3,207,215 A * 9/1965 Whittell, Jr. ..... F24H 1/145 165/134.1
3,292,598 A * 12/1966 Miller ..... F24H 1/145 122/406.1
4,023,618 A * 5/1977 Kun ..... F28D 9/00 165/148

(Continued)

FOREIGN PATENT DOCUMENTS

DE 102009015467 A1 * 9/2010 ..... F02B 29/0462
JP 63197893 A * 8/1988

(Continued)

*Primary Examiner* — David Teitelbaum
*Assistant Examiner* — For K Ling
(74) *Attorney, Agent, or Firm* — Studebaker & Brackett PC

(57) ABSTRACT

A heat exchanger has a case housing a plurality of heat transfer tubes, a pair of header portions for water inflow and for water outflow, the pair of header portions connecting with both ends of the plurality of heat transfer tubes, and a pair of wall portions for headers respectively constituted with an auxiliary member formed separately from a side plate member of the case, the wall portions for headers constituting the pair of header portions by being assembled with the side plate member. The pair of wall portions for headers are configured to be integrally connected with each other. Thereby, production of the pair of header portions are facilitated and the production cost of the heat exchanger is reduced.

13 Claims, 13 Drawing Sheets

(56) References Cited

U.S. PATENT DOCUMENTS

| | | | | |
|---|---|---|---|---|
| 6,026,804 | A * | 2/2000 | Schardt | F24H 1/40 126/344 |
| 6,334,484 | B1 * | 1/2002 | Kandel | F28D 7/06 165/158 |
| 8,794,299 | B2 * | 8/2014 | Barfknecht | F28D 7/1692 123/568.12 |
| 2010/0221675 | A1 * | 9/2010 | Rowe | F22D 1/06 432/29 |
| 2012/0193080 | A1 * | 8/2012 | Rasmussen | F28D 7/06 165/173 |
| 2014/0090827 | A1 | 4/2014 | Iguchi et al. | |

FOREIGN PATENT DOCUMENTS

| | | | |
|---|---|---|---|
| JP | 2008-121959 | A | 5/2008 |
| JP | 2014-070844 | A | 4/2014 |

* cited by examiner

HEAT EXCHANGER

BACKGROUND OF THE INVENTION

Field of the Invention

The present invention relates to a heat exchanger to be used as a constitutional element of a water heater.

Description of the Related Art

One embodiment of a heat exchanger is disclosed in Patent Literature 1.

The disclosed heat exchanger has a pair of header portions for water inflow and water outflow on a side plate member of a case housing a plurality of heat transfer tubes. Each header portion is constituted in such a manner that a bulging portion bulging out of the case is formed on the side plate member of the case and that a wall portion for header constituted with an auxiliary member is fitted onto and welded to the bulging portion. End portions of the heat transfer tubes are welded to a tip end wall portion of the bulging portion. Thus, a chamber communicating with the heat transfer tubes is formed by the side plate member of the case and the wall portion for header of the auxiliary member.

In such a configuration, water is able to appropriately flow into or from the heat transfer tubes using the pair of header portions. The header portions are formed utilizing the side plate member of the case, thereby reducing the number of members and the size of installation, and in addition, reducing the production cost.

However, the above conventional art has the following disadvantages.

The pair of header portions provided for the side plate member of the case are constituted in such a manner that two wall portions for headers which are separately formed using the auxiliary members are welded to the side plate member of the case. Therefore, for producing the header portions, two wall portions for headers are respectively manufactured in advance and are positioned relative to the side plate member of the case, and welding is respectively executed. Such a production procedure of the header portions is rather complicated.

On the other hand, as to a heat exchanger other than the above, Patent Literature 2 discloses another heat exchanger. In Patent Literature 2, the heat exchanger uses a helical heat transfer tube as a plurality of heat transfer tubes. Some heat transfer tubes are not helical tubes, and have smaller entire length and smaller flow path resistance than the helical heat transfer tube. Such a configuration reduces the pressure loss generated at the time of flowing water into the heat transfer tubes. When the non-helical heat transfer tube is provided in addition to the helical heat transfer tube in order to reduce the pressure loss, the configuration of the heat exchanger is complicated.

CITATION LIST

Patent Literature 1: Japanese Unexamined Patent Publication No. 2014-70844

Patent Literature 2: Japanese Unexamined Patent Publication No. 2008-121959

SUMMARY OF THE INVENTION

An object of the present invention is to provide a heat exchanger capable of appropriately inhibiting or preventing the above-mentioned disadvantages.

The present invention proposes the following technical measures for solving the above-mentioned problems.

A heat exchanger proposed in the present invention has a plurality of heat transfer tubes, a case having at least one side plate member and housing the plurality of heat transfer tubes, a pair of header portions for water inflow and for water outflow, the pair of header portions connecting with both ends of the plurality of heat transfer tubes and including a pair of chambers communicating with insides of the heat transfer tubes, and a pair of wall portions for headers respectively constituted with an auxiliary member formed separately from the side plate member, the pair of wall portions for headers constituting the pair of header portions by being assembled with the side plate member. The pair of wall portions for headers are configured to integrally connect with each other.

Preferably, the pair of wall portions for headers are respectively configured to bulge away from the side plate member and to have piping joint members communicated with insides of the respective chambers.

Preferably, the auxiliary member has an extending plate portion connected with the pair of wall portions for headers and extending so as to expand around the pair of wall portions for headers, and the auxiliary member is assembled with the side plate member in such a manner that the extending plate portion and the side plate member come into contact so as to face each other and are welded or blazed.

Preferably, the side plate member of the case has a pair of bulging portions bulging into an outward side or into an inward side of the case, and the pair of wall portions for headers are configured so as to fit to the pair of bulging portions.

Preferably, the heat exchanger in the present invention further has a bypass flow path constituted by the side plate member and the auxiliary member, the bypass flow path connecting the pair of chambers.

Preferably, the side plate member and the auxiliary member form an area between the pair of wall portions for headers facing each other, and at least one of the side plate member and the auxiliary member has a concave portion depressed in a direction departing from the other of the members in the area, an inside of the concave portion constituting the bypass flow path.

Preferably, the other of the side plate member and the auxiliary member has a convex portion so as to fit into the concave portion, and contact surfaces of the convex portion and the concave portion are joined.

Preferably, the auxiliary member and the side plate member are overlapped and joined, the pair of wall portions for headers are configured to bulge away from the side plate member, and the auxiliary member has a wall portion for bypass flow path of which both end portions connect with the pair of wall portions for headers, the wall portion for bypass flow path depressing in the direction departing from the side plate member and constituting the concave portion.

Preferably, the auxiliary member has an extending plate portion connected with the pair of wall portions for headers and the wall portion for bypass flow path, and extending so as to expand around the wall portions for headers and the wall portion for bypass flow path, and the extending plate portion and the side plate member come into contact so as to face each other and are welded or blazed.

Preferably, the auxiliary member is substantially the same in size as the side plate member.

Preferably, the auxiliary member is shaped along the outline of the pair of wall portions for headers and the wall portion for bypass flow path and is smaller than the side plate member.

Preferably, the pair of chambers are located so as to have height difference in a vertical height direction, and one end portion of the bypass flow path connects with a part lower than a center part of the chamber located at a higher position in a vertical height direction.

Preferably, the case includes a case body of which open portion to be closed by the side plate member is formed at an end in a width direction, and a peripheral portion of the opening portion, an outer peripheral portion of the side plate member and an outer peripheral portion of the auxiliary member are overlapped with each other, and the case body, the side plate member and the auxiliary member are joined at thus overlapped part.

Preferably, the outer peripheral portions of the side plate member and the auxiliary member are respectively provided with a first bent portion and a second bent portion bending in an outward direction of the case, and on the overlapped part of the peripheral portion of the opening portion and the outer peripheral portions of the side plate member and the auxiliary member, the side plate member is fitted into the opening portion and the second bent portion of the auxiliary member is fitted into the first bent portion of the side plate member.

Other characteristics and advantages of the present invention will be apparent in the following detailed description of the preferred embodiment referring to the attached drawings.

DETAILED DESCRIPTION OF THE PREFERRED EMBODIMENT

Preferred embodiments of the present invention are explained below with reference to the accompanying drawings.

FIG. 1 to FIG. 11 show one embodiment of a heat exchanger of the present invention.

A heat exchanger A1 in this embodiment is, for example, a heat exchanger for recovering latent heat for use in a water heater and is used for heating water by recovering heat from combustion gas generated by a burner, not shown in the figure, such as a gas burner.

Figure 1:
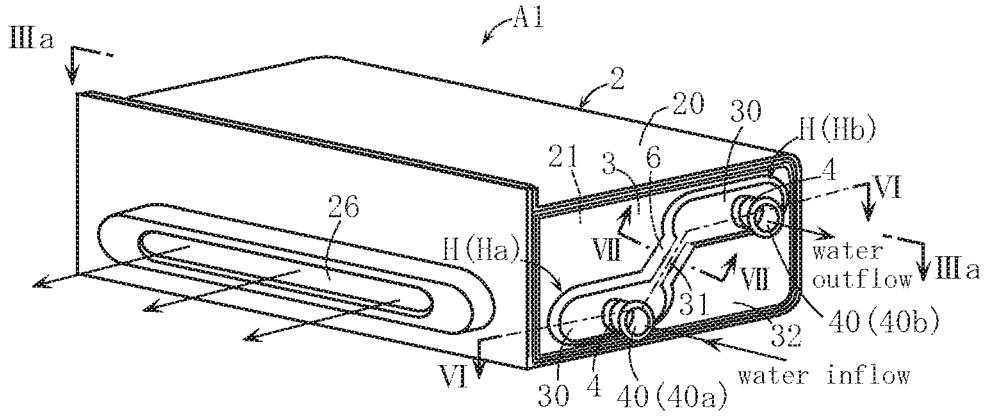
FIG. 1 is an externally perspective view showing one embodiment of a heat exchanger of the present invention.
Figure 2:
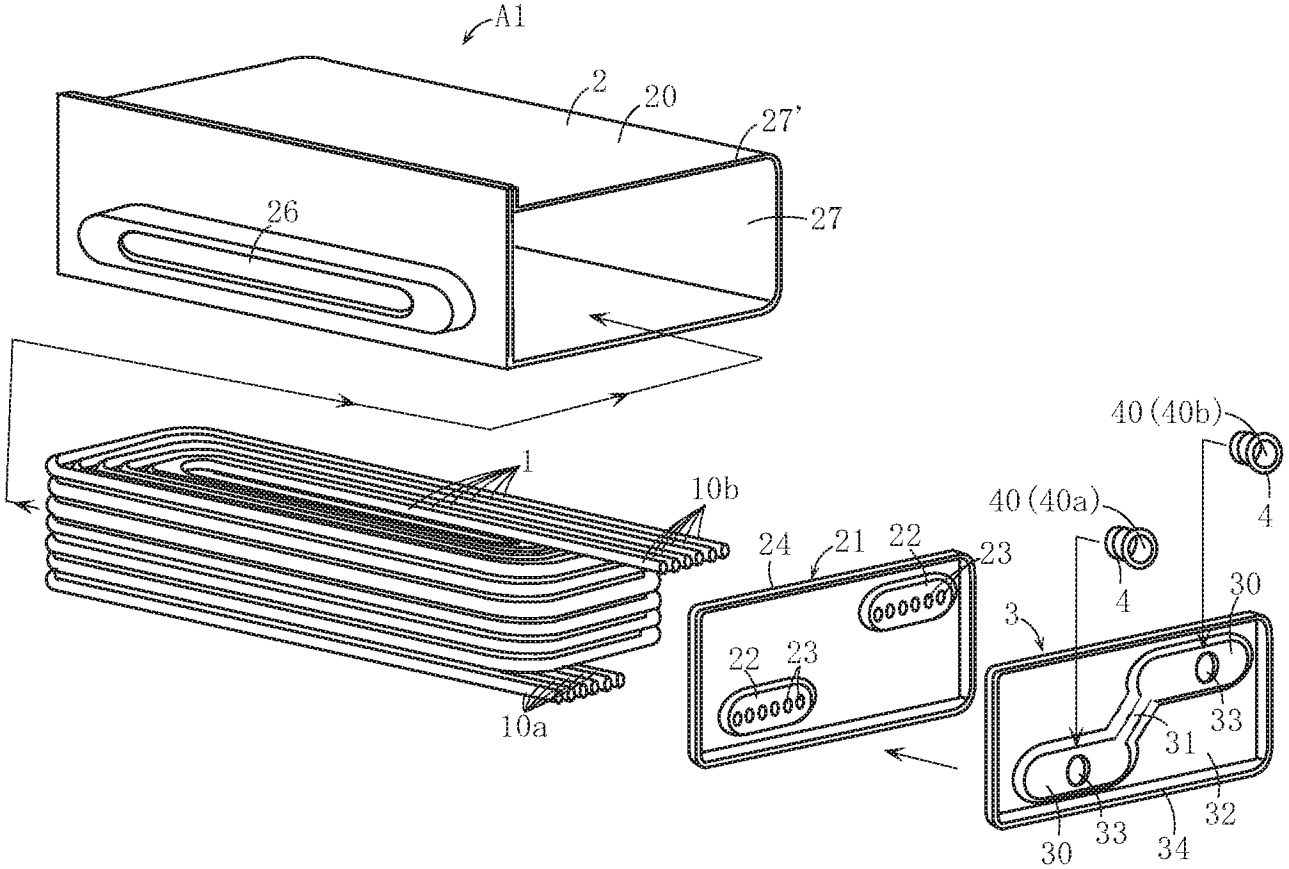
FIG. 2 is an exploded perspective view of FIG. 1.

As shown in FIG. 1 and FIG. 2, the heat exchanger A1 has an auxiliary member 3 and the present invention is characterized in the configuration of the auxiliary member 3. Basic configuration of the heat exchanger A1 is similar to that disclosed in the above-mentioned Patent Literature 1 other than the auxiliary member 3. Concretely, the heat exchanger A1 has, in addition to the auxiliary member 3, a case 2, a plurality of heat transfer tubes 1 housed in the case 2, and a pair of header portions for water inflow and water outflow H (Ha, Hb) connected to lower end portions and upper end portions of the heat transfer tubes 1, respectively. The heat exchanger A1 further has a bypath flow path 6 connecting the pair of header portions H.

Figure 3A:
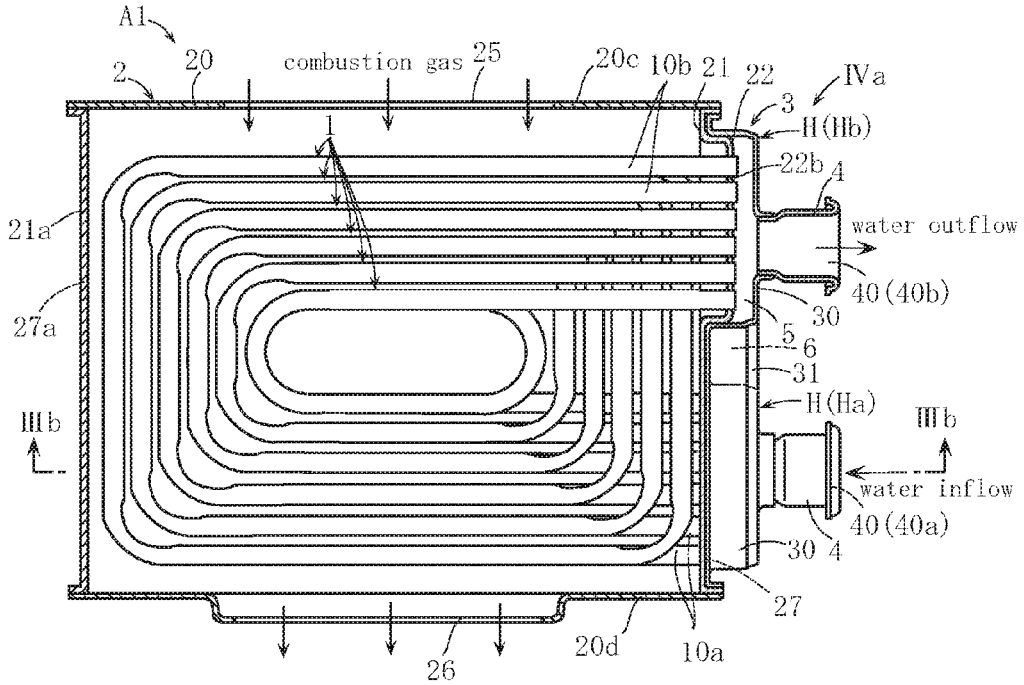
FIG. 3A is a sectional view taken along the line IIIa to IIIa in FIG. 1
Figure 3B:
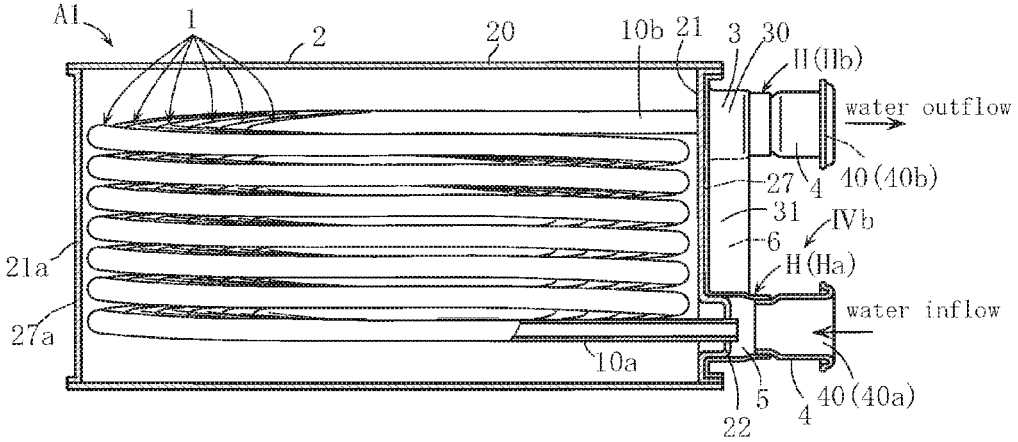
FIG. 3B is a sectional view taken along the line IIIb to IIIb in FIG. 3A.

As apparently shown in FIG. 3A and FIG. 3B, the heat transfer tubes 1 are formed with a plurality of helical tube bodies substantially in the form of a rectangle or an ellipse in plan view. The helical tube bodies have different sizes and are arranged to be wound and overlapped in a substantially concentric manner. Upper and lower heat transfer tubes 1 are straight tube bodies 10*a*, 10*b* extending almost horizontally.

The case 2, like a cuboid, is constituted by the combination of a case body 20, in the shape of a rectangular tube, constituting a stem body and a pair of side plate members 21, 21*a* closing opening portions 27, 27*a* at both ends of the case body 20 in the width direction. The case body 20 and the side plate members 21, 21*a* are respectively constituted with metal plates such as stainless steel. A rear wall portion 20*c* of the case 2 has an air supply port 25. Combustion gas flown into the case 2 from the air supply port 25 passes through gaps between the heat transfer tubes 1 and reaches an exhaust port 26 provided for a front wall portion 20*d*. In such a procedure, heat of combustion gas is recovered in each heat transfer tube 1 and water in each heat transfer tube 1 is heated.

The side plate member 21 of the case 2 has a pair of bulging portions 22 formed by press-working, the bulging portions 22 bulging out of the case 2 and being substantially in the shape of an ellipse in side view A plurality of aperture portions 23 are provided for tip end wall portions 22*b* of the bulging portions 22 and both end portions of the heat transfer tubes 1 are inserted into the aperture portions 23 and are welded to the tip end wall portions 22*b*, respectively.

The auxiliary member 3 is a member constituting the header portions H, the auxiliary member 3 being overlapped and joined with the outer face side of the side plate member 21. The auxiliary member 3 is manufactured by pressing a metal sheet made of similar material to the side plate member 21 and the outline shape and the size of the auxiliary member 3 correspond to those of the side plate member 21.

In FIG. 2, the auxiliary member 3 has a pair of wall portions for headers 30, a wall portion for bypass flow path 31 formed between the pair of wall portions for headers 30, and an extending plate portion 32 in the form of a plane plate connected with the wall portions 30, 31 and extending so as to expand around the wall portions 30, 31. The pair of wall portions for headers 30 are bulged in the shape and size corresponding to the bulging portions 22 of the side plate member 21. The auxiliary member 3 is arranged so as to overlap with the outer face of the side plate member 21, and each wall portion for header 30 is fitted onto a circumferential wall portion 22*a* of the bulging portion 22, referring to FIG. 3 to FIG. 5, FIG. 8 and FIG. 9. Such fitting is executed in such a manner that a chamber 5 communicating with the heat transfer tubes 1 is formed between the tip end wall portion 22*b* of the bulging portion 22 and the wall portion for header 30. Thus, the header portions H for inflow and outflow of water are configured. The wall portion for header 30 is provided with an aperture portion 33 and a piping joint member 4 is attached utilizing the aperture portion 33. An opening 40 of the piping joint member 4 is an inflow port for water 40 (40*a*) or an outflow port for heated water 40 (40*b*) and a pair of joint members 4 are coupled with an inflow tube for water and an outflow tube for heated water, which are not shown in the figure.

Figure 6:
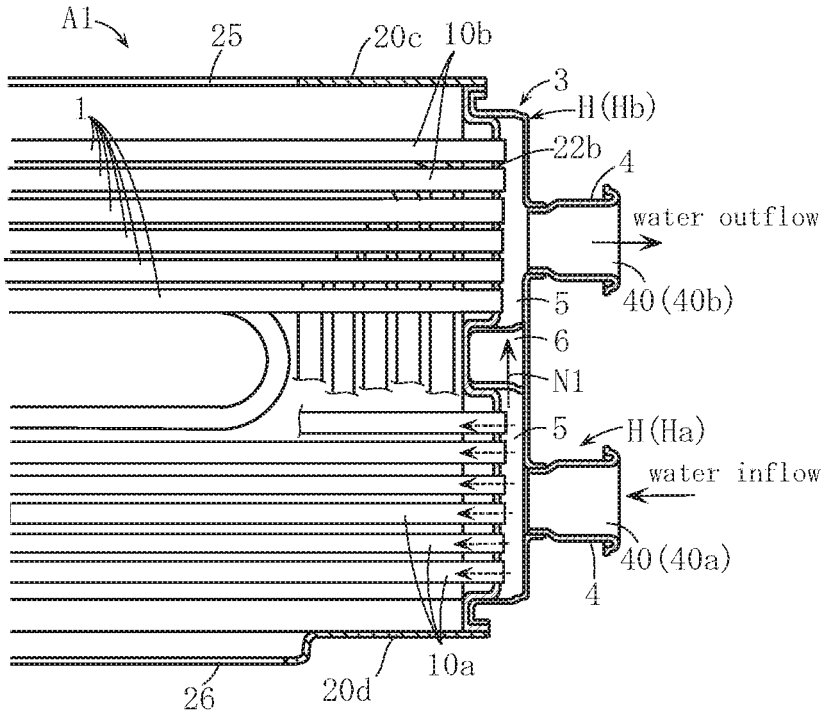
FIG. 6 is a sectional view of an essential part taken along the line VI to VI in FIG. 1.
Figure 7:
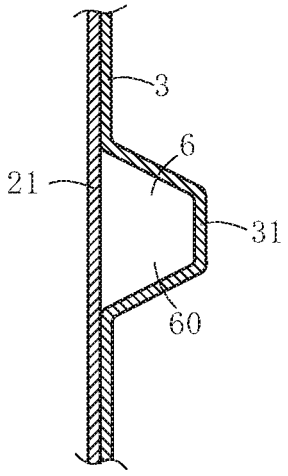
FIG. 7 is a sectional view of an essential part taken along the line VII to VII in FIG. 1.
Figure 8:
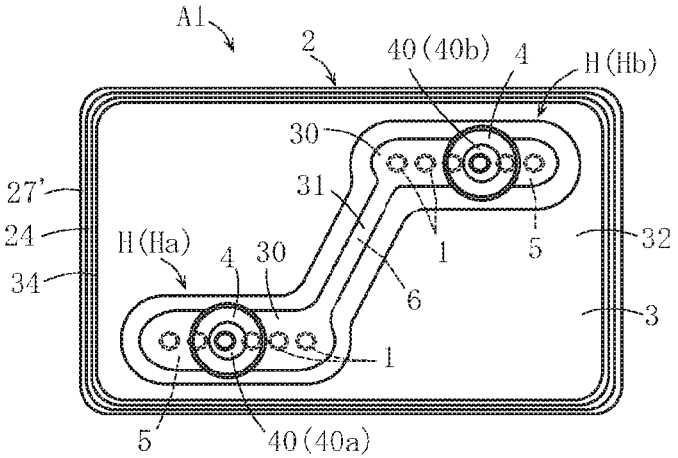
FIG. 8 is a side view of the heat exchanger in FIG. 1.
Figure 9:
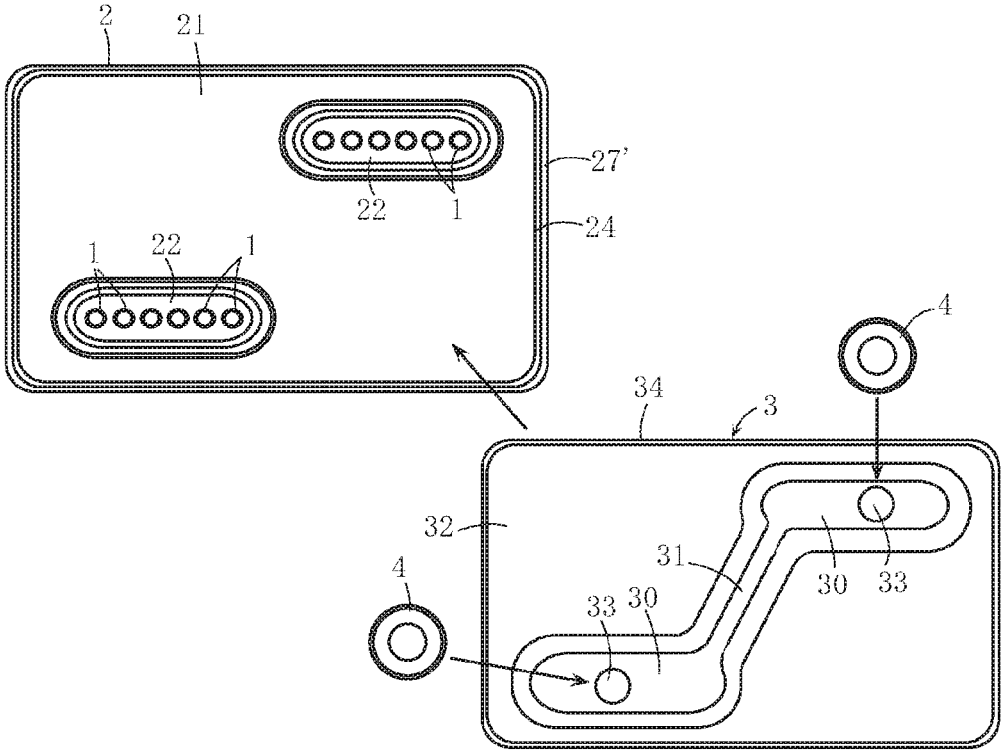
FIG. 9 is an exploded side view of FIG. 8.

In FIG. 6, the bypass flow path 6 connects the chambers 5 of the pair of header portions H and flows a part of water entered in the header portion for water inflow Ha into the header portion for water outflow Hb as shown with an arrow N1. As shown in FIG. 7, the wall portion for bypass flow path 31 of the auxiliary member 3 forms a concave portion 60 depressed in the direction departing from the side plate member 21, namely in the outward direction of the case 2. Both ends of the concave portion 60 connect with the pair of chambers 5. The inside of the concave portion 60 is a space formed between the wall portion for bypass flow path 31 and the side plate member 21 facing each other, and constitutes the bypass flow path 6.

The header portion Hb is located higher than the header portion Ha. One end of the bypass flow path 6 is connected with a lower part of the header portion Hb than the center part in the vertical height direction. Preferably, the end connects with a lower end portion of the header portion Hb or with the vicinity of the lower end portion. Such a configuration exerts an advantageous effect for removing water from the header portion Hb, to be mentioned below.

Figure 4A:
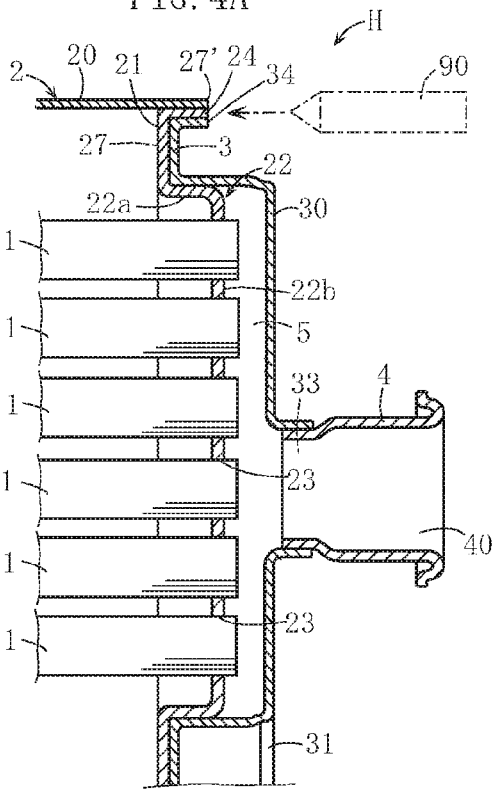
FIG. 4A is an enlarged sectional view of a part IVa in FIG. 3A.
Figure 4B:
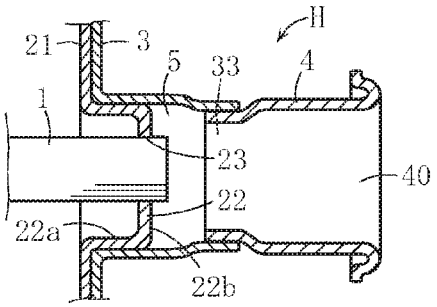
FIG. 4B is an enlarged sectional view of a part IVb in FIG. 3B.
Figure 5:
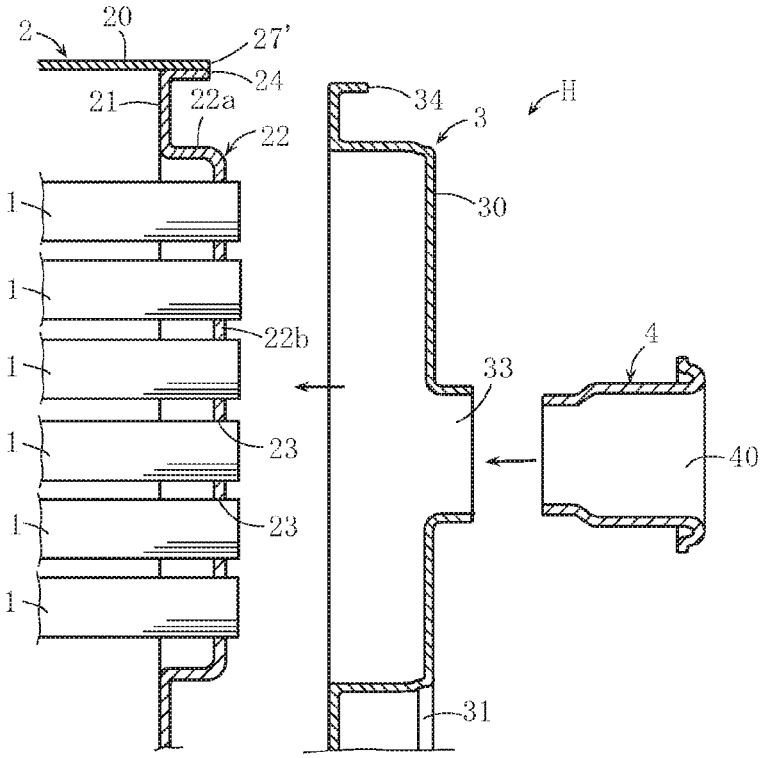
FIG. 5 is an exploded sectional view of FIG. 4A.

As apparently shown in FIG. 4A and FIG. 5, a first and a second bent portions 24, 34 bent in the outward direction of the case 2 are respectively provided for outer peripheral portions of the side plate member 21 and the auxiliary member 3. The first and the second bent portions 24, 34 are consecutively formed almost around the entire outer peripheries of the side plate member 21 and the auxiliary member 3, and are in the shape of a frame or a rectangular tube. Three members, i.e. the case body 20, the side plate member 21 and the auxiliary member 3, are assembled under such a condition that; the side plate member 21 is fitted into the opening portion 27 of the case body 20, and the second bent portion 34 of the auxiliary member 3 is fitted into the first bent portion 24 of the side plate member 21. Thus, as apparently shown in FIG. 4A, a peripheral portion 27' of the opening portion 27 of the case body 20, the first bent portion 24 of the side plate member 21 and the second bent portion 34 of the auxiliary member 3 are overlapped with each other and the overlapped part is welded, for example, by TIG welding. The members are able to be welded together when a jig for welding 90 is arranged so as to face the peripheral portion 27' and the first and the second bent portions 24, 34.

Figure 10:
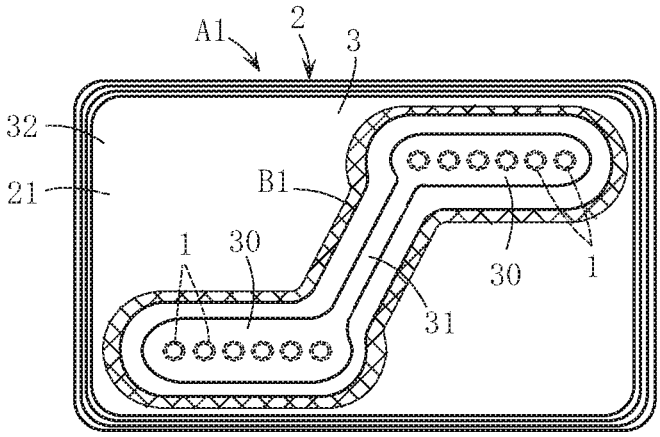
FIG. 10 is a side view showing one example of welding or blazing in the heat exchanger in FIG. 1.
Figure 11:
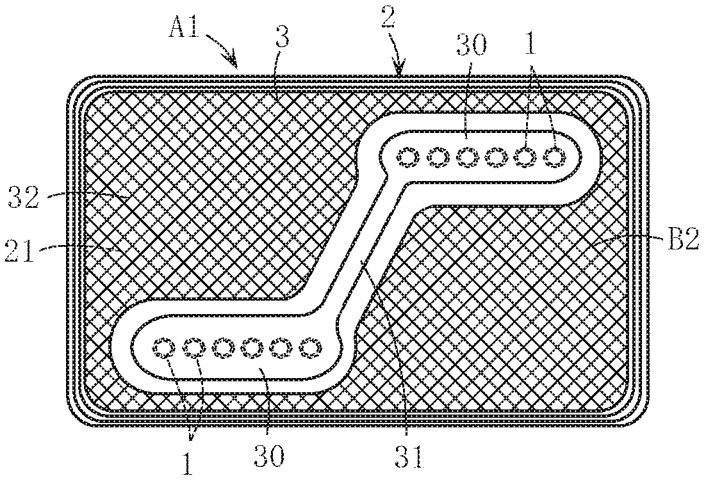
FIG. 11 is a side view showing another example of welding or blazing in the heat exchanger in FIG. 1.

Preferably, as shown in FIG. 10 and FIG. 11, additional welding or blazing is executed for the auxiliary member 3. In the configuration shown in FIG. 10, an area B1 of an extending plate portion 32 of the auxiliary member 3, namely a cross-hatched area B1 in the figure, is welded to the side plate member 21, the area B1 being along the outlines of the wall portions for headers 30 and the wall portion for bypass flow path 31. In the configuration shown in FIG. 11, an area B2 of the extending plate portion 32 of the auxiliary member 3, namely a cross-hatched area B2 in the figure, is blazed to the side plate member 21, the area B2 being a substantially flat plate portion excluding the wall portions for headers 30 and the wall portion for bypass flow path 31.

Such a configuration is preferable to surely prevent water in the chamber 5 and the bypass flow path 6 from leaking into the area between the side plate member 21 and the auxiliary member 3. When the second bent portion 34 of the auxiliary member 3 is only welded to the first bent portion 24 of the side plate member 21, a gap is formed between facing surfaces of the extending plate portion 32 of the auxiliary member 3 and the side plate member 21 in case that the pressure of water supplied to the header portion for water inflow Ha is comparatively high, thereby there is a worry that water in the chamber 5 and the bypass flow path 6 leaks into the gap. On the other hand, in the configurations shown in FIG. 10 and FIG. 11, such a worry is able to be solved. When the heat exchanger A1 is, for example, used for a hot water supply system and the water supply pressure is comparatively high, the configurations shown in FIG. 10 or FIG. 11 are desired. On the other hand, when the heat exchanger A1 is used for a hot water heating system or a reheating system for bath and the water supply pressure is comparatively low, there is no disadvantage even when the configurations shown in FIG. 10 or FIG. 11 are not adopted.

Operational effects of the above-mentioned heat exchanger A1 are explained hereinafter.

The pair of header portions H are configured in such a manner that the auxiliary member 3, a single member, and the side plate member 21 of the case 2 are overlapped and joined. For constituting the pair of header portions H, there is no need for two members to be respectively joined with the side plate member 21. Therefore, the pair of header portions H are easily constituted and the production cost of the heat exchanger A1 is reduced.

Especially in this embodiment, as explained referring to FIG. 4A, the peripheral portion 27' of the opening portion 27 of the case body 20, the first bent portion 24 of the side plate member 21, and the second bent portion 34 of the auxiliary member 3 are fitted to and overlapped with each other, then the overlapped part is welded. Therefore, in addition to welding of the auxiliary member 3 to the side plate member 21, the side plate member 21 is also welded to the case body 20 at one time. Assembly and positioning of the above-mentioned three members before welding are facilitated. As a result, production of the heat exchanger A1 is further facilitated. In addition, the pair of wall portions for headers 30 provided for the auxiliary member 3 bulge so as to be fitted onto the pair of bulging portions 22 of the side plate member 21, so that there is an advantageous effect that members and parts of the header portion H are accurately positioned so as not to generate unnecessary gaps therebetween.

The chambers 5 of the pair of header portions H are connected via the bypass flow path 6 and a part of water flown into the header portion for water inflow Ha is able to flow into the header portion for water outflow Hb, as explained referring to FIG. 6. For example, compared with the case that all of water flown into the header portion Ha is flown into the heat transfer tubes 1, the pressure loss is reduced. Therefore, such troublesome operations that a short heat transfer tube is provided in addition to the heat transfer tubes 1 in order to reduce the pressure loss of water flow are able to be eliminated.

Non-heated water at comparatively low temperature, which is not supplied to the heat transfer tubes 1, flows into the bypass flow path 6. Therefore, an advantageous effect is obtained such that the side plate member 21 is cooled down by the above water and is prevented from being heated to a high temperature by combustion gas. Such an advantageous effect is preferable when the heat exchanger A1 is provided close to a burner in order to recover heat from combustion gas at high temperature.

For antifreeze of the heat exchanger A1 in winter and maintenance of the heat exchanger A1, water is sometimes removed from the heat transfer tubes 1 and the header portions H. The bypass flow path 6 has a role of flowing water in the header portion Hb to the the header portion Ha at the time of the above-mentioned water removal operation. When one end portion of the bypass flow path 6 connects with a lower part of the header portion Hb, there is such an advantageous effect that much water is flown into the bypass flow path 6 from the header portion Hb so as not to remain much water in the header portion Hb.

FIG. 12 to FIG. 17 show another embodiments of the present invention. In the figures, the elements same as or similar to those in the above-mentioned embodiment are allotted with the same reference numerals and redundant explanation is omitted.

Figure 12A:
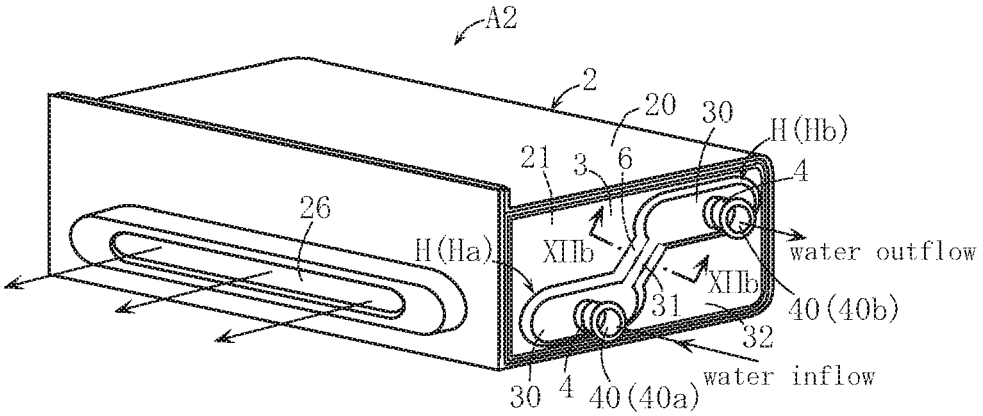
FIG. 12A is an externally perspective view showing another embodiment of the present invention and FIG. 12B is a sectional view of an essential part taken along the line XIIb to XIIb in FIG. 12A.
Figure 12B:
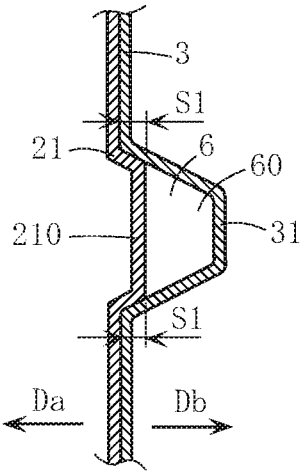

A heat exchanger A2 shown in FIG. 12A and FIG. 12B has a convex portion 210 provided for the side plate member 21. The convex portion 210 is fitted into the vicinity of the opening portion of the concave portion 60 of the wall portion for bypass flow path 31. The convex portion 210 and the concave portion 60 come into contact in an area shown with the reference numeral S1, and are blazed at the contacting area.

When the plane faces of the side plate member 21 and the auxiliary member 3 are only come into contact so as to face each other and are blazed, there is a worry in view of improving the joint strength of blazing relative to the forces in the directions Da, Db shown in FIG. 12B. On the other hand, such blazing in the area shown with the reference numeral S1 is not in the directions Da, Db, thereby improving the joint strength relative to the forces in the directions Da, Db.

Figure 13A:
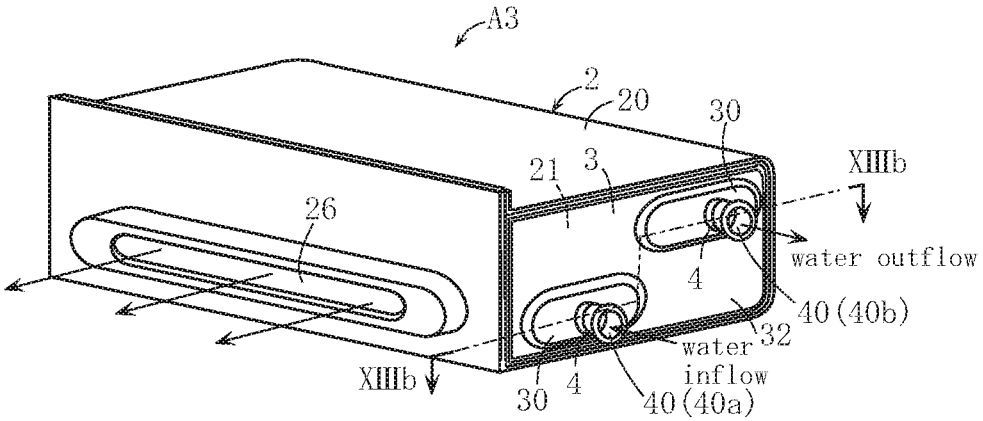
FIG. 13A is an externally perspective view showing another embodiment of the present invention and FIG. 13B is a sectional view of an essential part taken along the line XIIIb to XIIIb in FIG. 13A.
Figure 13B:
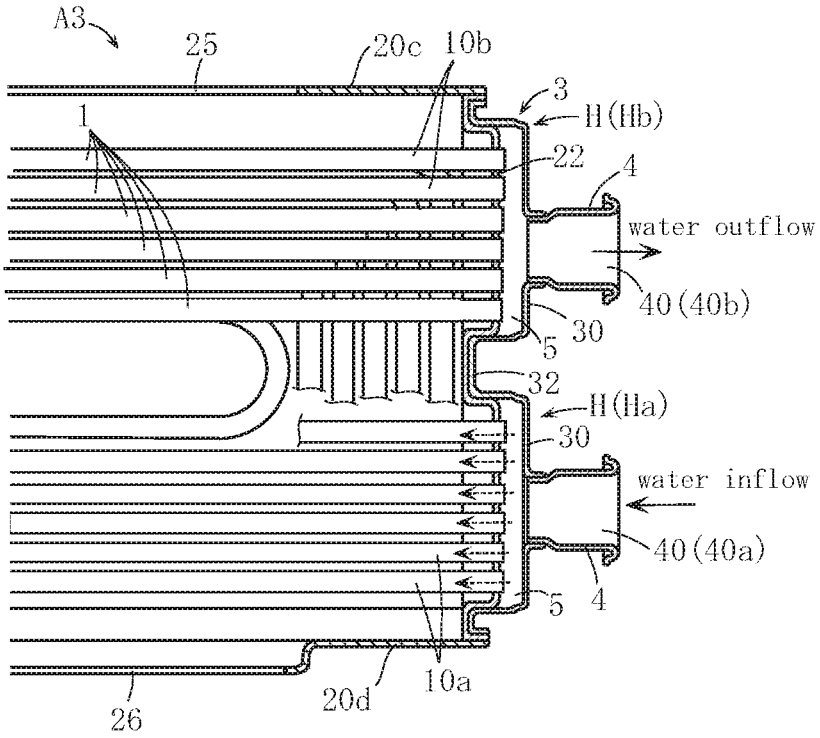

A heat exchanger A3 shown in FIG. 13A and FIG. 13B is not provided with members corresponding to the bypass flow path 6 and the wall portion for bypass flow path 31 mentioned in the above-mentioned embodiments. The bypass flow path 6 is preferable to reduce the pressure loss of water flow, but it can be omitted like this embodiment.

Figure 14A:
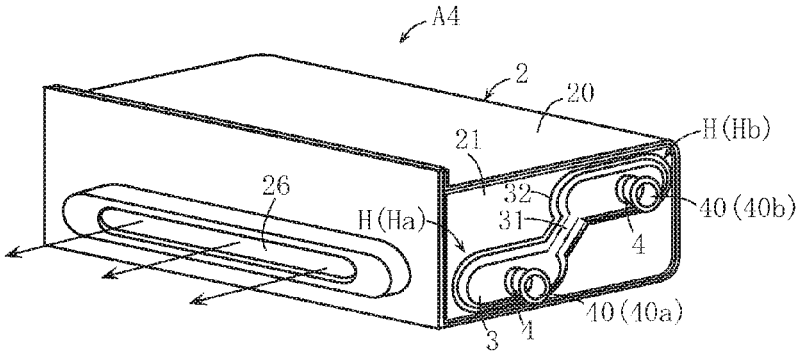
FIG. 14A is an externally perspective view showing another embodiment of the present invention and FIG. 14B is an exploded perspective view of FIG. 14A.
Figure 14B:
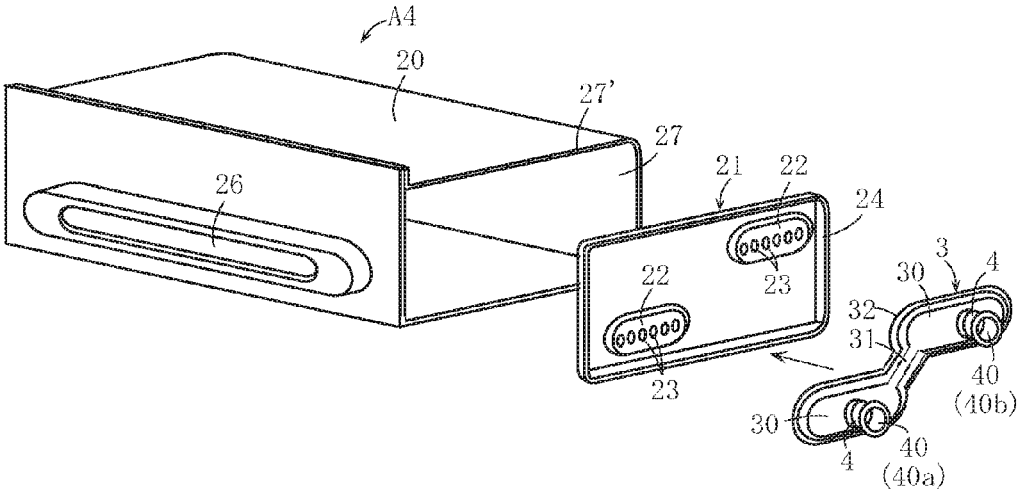

In a heat exchanger A4 shown in FIG. 14A and FIG. 14B, the auxiliary member 3 is configured in such a manner that the pair of wall portions for headers 30 are connected via the wall portion for bypass flow path 31. The extending plate portion 32 connected with the wall portions for headers 30 and the wall portion for bypass flow path 31 is relatively small or is not actually provided. Thus, the entire outline of the auxiliary member 3 is along the wall portions for headers 30 and the wall portion for bypass flow path 31 and is smaller than that of the side plate member 21. For assembling the side plate member 21 with the auxiliary member 3, the outer peripheral portion of the auxiliary member 3 is welded or blazed to the side plate member 21.

In this embodiment, the heat exchanger A4 is able to be reduced in weight and in production cost by downsizing the auxiliary member 3. The bypass flow path 6 can be omitted in the present invention as mentioned above. In such a case, a region integrally connecting the wall portions for headers 30 can be formed like a simple plane plate.

Figure 15A:
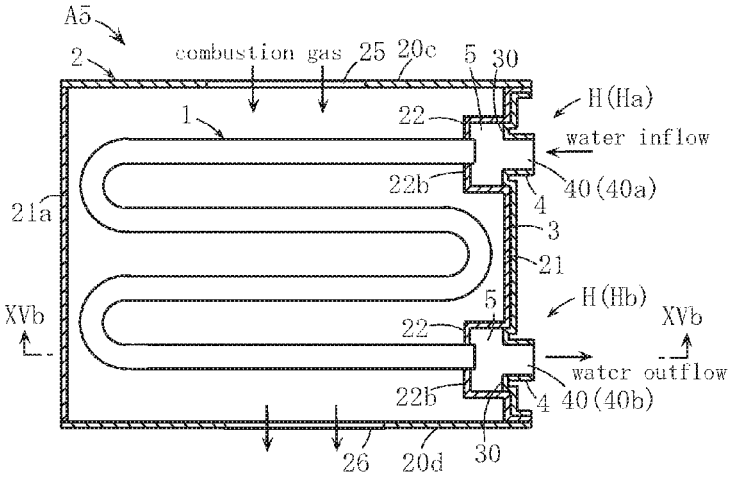
FIG. 15A is a plan sectional view showing another embodiment of the present invention.
Figure 15B:
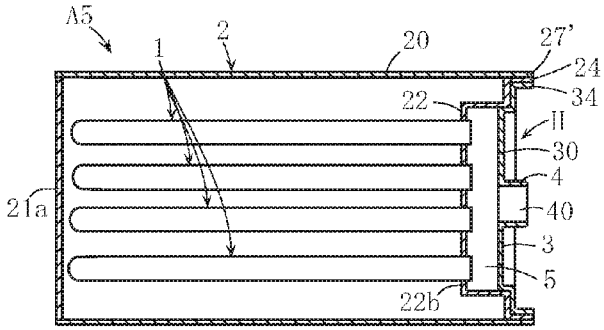
FIG. 15B is a sectional view taken along the line XVb to XVb in FIG. 15A.
Figure 15C:
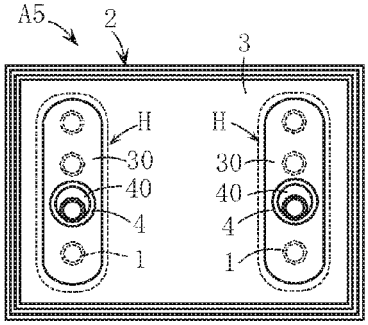
FIG. 15C is the right side view.

In a heat exchanger A5 shown in FIG. 15A to FIG. 15C, the plurality of heat transfer tubes 1 are meandering tube bodies in a substantially horizontal manner and are arranged in the vertical height direction. The both ends of each heat transfer tube 1 are joined with the tip end wall portion 22*b* of the bulging portion 22 provided for the side plate member 21 of the case 2, the bulging portion 22 bulging into the inward direction of the case 2. The wall portion for header 30 of the auxiliary member 3 is bulged in the inward direction of the case 2 and is further fitted into the bulging portion 22, thereby constituting the header portion H in combination with the bulging portion 22. In FIG. 15A to FIG. 15C, the joint member 4 constituting the inflow port for water 40*a* or the outflow port for water 40*b* is shown in a simplified manner, the same applying to FIG. 16A to FIG. 16C.

As understood from this embodiment, the meandering heat transfer tubes 1 is used or the bulging portions 22 provided for the side plate member 21 bulges in the inward direction of the case 2 in the present invention. In FIG. 15A to FIG. 15C, the bypass flow path 6 connecting the pair of chambers 5 is omitted; however the bypass flow path 6 can be provided, the same applying to FIG. 17.

Figure 16A:
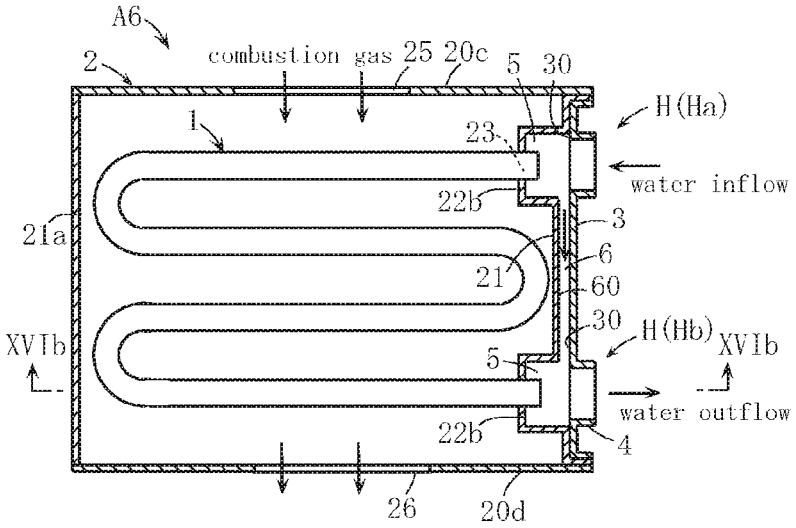
FIG. 16A is a plan sectional view showing another embodiment of the present invention.
Figure 16B:
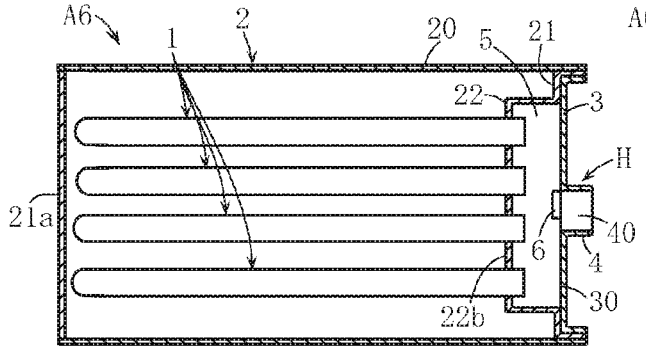
FIG. 16B is a sectional view taken along the line XVIb to XVIb in FIG. 16A.
Figure 16C:
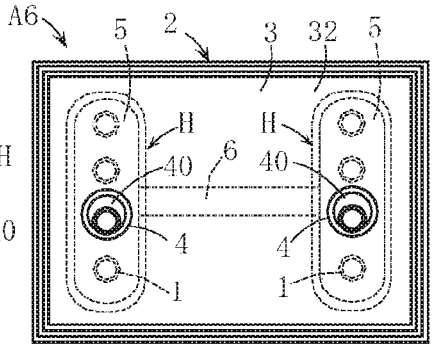
FIG. 16C is the right side view.

The shape of the auxiliary member 3 of a heat exchanger A6 shown in FIG. 16A to FIG. 16C is different from that of the heat exchanger A5 shown in FIG. 15A to FIG. 15C. The auxiliary member 3 in this embodiment is configured to bulge so as to fit to the bulging portion 22 of the side plate member 21. As apparently shown in FIG. 16B, the wall portion for header 30 is a flat wall portion closing the opening portion of the bulging portion 22. On the other hand, the concave portion 60 is provided for the side plate member 21 between the pair of bulging portions 22 and the bypass flow path 6 is provided utilizing the concave portion 60.

As understood from this embodiment, the wall portion for header of the auxiliary member in the present invention is not necessarily configured to be bulged. In addition, the bypass flow path 6 can be formed in such a manner that the concave portion 60 is provided for the side plate member 21, the auxiliary member 3, or both of the side plate member 21 and the auxiliary member 3.

Figure 17:
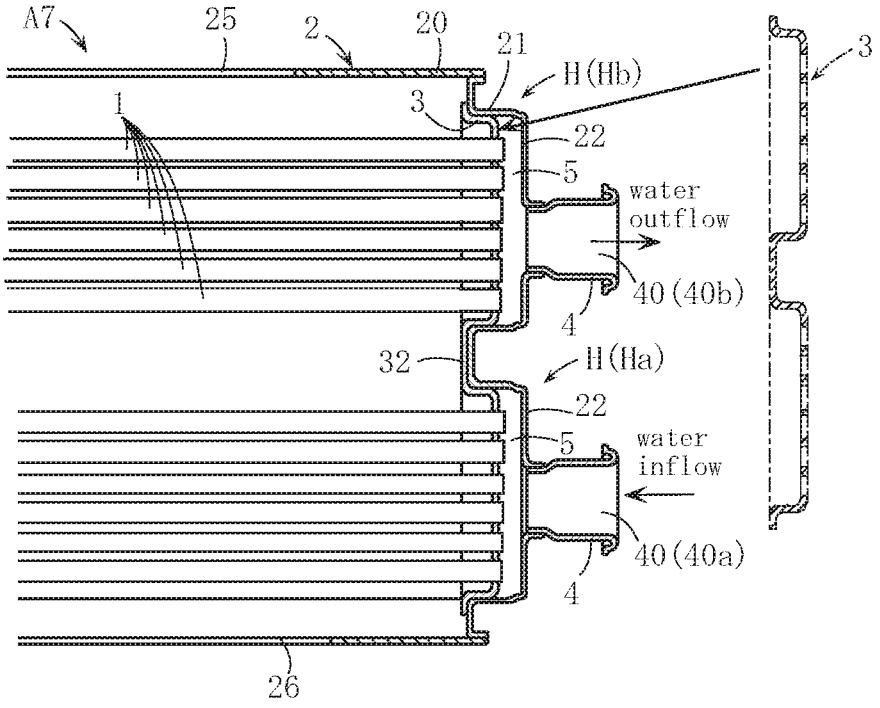
FIG. 17 is a sectional view of an essential part showing another embodiment of the present invention.

In a heat exchanger A7 shown in FIG. 17, the side plate member 21 of the case 2 is provided with the pair of bulging portions 22 bulging out of the case 2 and the joint members 4 are respectively attached to the bulging portions 22. On the other hand, the auxiliary member 3 is arranged inside the side plate member 21 so as to close the inner opening portions of the bulging portions 22 and is joined with the side plate member 21. The ends of the heat transfer tubes 1 are joined with the auxiliary member 3 and the chamber 5 communicating with each heat transfer tube 1 is formed in the bulging portion 22. As shown in this embodiment, the auxiliary member 3 can be provided inside the side plate member 21 and the end portions of the heat transfer tubes 1 can be joined with the auxiliary member 3.

The present invention is not limited to the above-mentioned preferred embodiments. The concrete configuration of the members of the heat exchanger of the present invention is freely designed within the intended scope of the present invention.

As understood from the above embodiments, the auxiliary member in the present invention is only required to be formed separately from the side plate member of the case and to be configured in such a manner that at least a pair of wall portions for headers, namely wall portions constituting the header portions by being assembled with the side plate member, are integrally formed. The side plate member of the case cannot be formed separately from the case body and can be formed by bending the area thereof integrally connecting with the member constituting the case body. The heat exchanger in the above-mentioned embodiments is a one water path in one case system, namely a system in which a heat transfer tube constituting one water path is housed in one case. Alternatively, a multi water paths in one case system, namely a system in which heat transfer tubes constituting a plurality of water paths are housed in one case, can be used. In such a case, a plural pairs of a header portion for water inflow and a header portion for water outflow are provided. When at least one pair of header portions are constituted according to the present invention, such an auxiliary member is included in the technical scope of the present invention.

The heat transfer tube is not limited to be a helical tube body or a meandering tube body. Other heat transfer tubes, such as a U-shaped tube or a straight tube, can be used. The heat exchanger in the present invention is not limited to be used for a water heater for recovering latent heat, but is also used for a water heater for recovering sensible heat. In addition, the heat exchanger can be used for several purposes in addition to heating water.

The invention claimed is:

1. A heat exchanger comprising: a plurality of heat transfer tubes;

a case having at least one side plate member and housing the plurality of heat transfer tubes;

a pair of header portions for water inflow and for water outflow, the pair of header portions connecting with both ends of the plurality of heat transfer tubes and including a pair of chambers communicating with insides of the heat transfer tubes;

a pair of wall portions for the pair of header portions respectively constituted with an auxiliary member formed separately from the side plate member, the pair of wall portions for the pair of header portions constituting the pair of header portions by being assembled with the side plate member; and are configured to be integrally connected with each other; and a bypass flow path constituted by the side plate member and the auxiliary member, the bypass flow path connecting the pair of chambers, wherein the pair of wall portions for the pair of header portions and a wall portion of the bypass flow path of the auxiliary member are integrally formed by pressing a metal sheet.

2. The heat exchanger according to claim 1, wherein the pair of wall portions for the pair of header portions are respectively configured to bulge away from the side plate member and to have piping joint members communicated with the respective chambers.

3. The heat exchanger according to claim 1, wherein the auxiliary member has an extending plate portion connected with the pair of wall portions for the pair of header portions and extending so as to expand around the pair of wall portions for the pair of header portions, and the auxiliary member is assembled with the side plate member in such a manner that the extending plate portion and the side plate member come into contact so as to face each other and are welded or blazed.

4. The heat exchanger according to claim 1, wherein the side plate member of the case has a pair of bulging portions bulging into an outward side or into an inward side of the case, and the pair of wall portions for the pair of header portions are configured to fit to the pair of bulging portions.

5. The heat exchanger according to claim 1, wherein the side plate member and the auxiliary member form an area between the pair of wall portions for the pair of header portions facing each other, and at least one of the side plate member and the auxiliary member has a concave portion depressed in a direction departing from an other of the side plate member and the auxiliary member in the area, an inside of the concave portion constituting the bypass flow path.

6. The heat exchanger according to claim 5, wherein the other of the side plate member and the auxiliary member has a convex portion so as to fit into the concave portion, and contact surfaces of the convex portion and the concave portion are joined.

7. The heat exchanger according to claim 6, wherein the auxiliary member and the side plate member are overlapped and joined, the pair of wall portions for the pair of header portions are configured to bulge away from the side plate member, and the auxiliary member having the wall portion of the bypass flow path of which both end portions connect with the pair of wall portions for the pair of header portions, the wall portion of the bypass flow path depressing in the direction departing from the side plate member and constituting the concave portion.

8. The heat exchanger according to claim 7, wherein the auxiliary member has an extending plate portion connected with the pair of wall portions for the pair of header portions and the wall portion of the bypass flow path, and extending so as to expand around the wall portions for headers and the wall portion of the bypass flow path, and the extending plate portion and the side plate member come into contact so as to face each other and are welded or blazed.

9. The heat exchanger according to claim 7, wherein the auxiliary member is substantially the same in size as the side plate member.

10. The heat exchanger as set forth in claim 7, wherein the auxiliary member is shaped along an outline of the wall portions for headers and the wall portion of the bypass flow path, and is smaller than the side plate member.

11. The heat exchanger according to claim 1, wherein the pair of chambers are located so as to have height difference in a vertical height direction, and one end portion of the bypass flow path connects with a part lower than a center part of the chamber located at a higher position in a vertical height direction.

12. The heat exchanger according to claim 1, wherein the case includes a case body of which an open portion to be closed by the side plate member is formed at an end in a width direction, and a peripheral portion of the opening portion, an outer peripheral portion of the side plate member and an outer peripheral portion of the auxiliary member are overlapped with each other, and the case body, the side plate member and the auxiliary member are joined at thus an overlapped part.

13. The heat exchanger as set forth in claim 12, wherein the outer peripheral portions of the side plate member and the auxiliary member are respectively provided with a first bent portion and a second bent portion bending in an outward direction of the case, and on the overlapped part of the peripheral portion of the opening portion and the outer peripheral portions of the side plate member and the auxiliary member, the side plate member is fitted into the opening portion and the second bent portion of the auxiliary member is fitted into the first bent portion of the side plate member.

* * * * *